US005353824A

United States Patent [19]

Woods et al.

[11] Patent Number: 5,353,824

[45] Date of Patent: Oct. 11, 1994

[54] BIFOLD SEAT FOR FOLDING WALKER

[76] Inventors: Carlton M. Woods; Nancy R. Woods, both of 270 Whidah Rd., North Chatham, Mass. 02650

[21] Appl. No.: 166,700

[22] Filed: Dec. 14, 1993

[51] Int. Cl.[5] ..... A45B 3/00

[52] U.S. Cl. ..... 135/66; 135/67; 297/6; 297/44

[58] Field of Search ..... 135/65-67, 135/74; 297/6, 44; 482/66, 68; 280/87.021

[56] References Cited

U.S. PATENT DOCUMENTS 715,978 12/1902 Carroll ..... 297/6

4,946,058 8/1990 Stamm ..... 136x/67 X

*Primary Examiner*—Carl D. Friedman

*Assistant Examiner*—Lan C. Mai

[57] ABSTRACT

An improved folding seat which can be attached to many different designs of walkers including rigid types and foldable walkers including a folding walker having a frame consisting of a left side A-frame and a right side A-frame with each side A-frame having a fixed vertically extending front leg, a folding vertically extending rear leg and a side brace connecting the front and rear legs and a cross brace for pivotally connecting the left side A-frame to the right side A-frame, in a manner that enables the side A-frames to be moved between closed and open positions; and a bifold seat panel for pivotal attachment to the frame means having two pivotally connected seat panels, a pair of articulated arms including arched cross rods connecting a right articulated arm to a left articulated arm having a combination handle and center cross rod extending between a first central pivot point and a central pivot point, support devices for supporting the seat means on the frame including back support clamping devices for pivotally supporting the back of the bifold seat panel, front support belt for supporting the front of the bifold seat panel to permit the seat to be moved from a flat in-use position to a raised folded position stored against the front of said folding walker permitting use as a walker.

8 Claims, 4 Drawing Sheets

BIFOLD SEAT FOR FOLDING WALKER

BACKGROUND OF THE INVENTION

The present invention relates to an improved folding seat for use with folding walkers, and particularly to a seat kit that can be quickly and simply attached to many walkers and affords instant security and comfort when a user of the walker feels faint or fatigued. Prior art folding walkers provide for limited mobility for users in need of assistance having limited reserve of strength. By permitting walking for patients otherwise committed to a wheel chair, the patient achieves more independence, however the need for assistance from care givers is still needed, particularly in the event the user tires and seeks a seated rest. Accordingly walkers are commonly used in home, extended health care facilities or hospitals because they help to reduce the personnel needed to assist persons having limited mobility.

Applicant is aware of other prior art devices which provide different forms of foldable seats having some of the operational features of the present invention for use with conventional walkers. Reference is hereby made to U.S. Pat. Nos. 4,826,240, 4,907,839, 4,643,211, 2,798,533, 5,224,721, and 1,448,783. The above noted U.S. Patents are representative of the current state of the art with respect to the subject matter of the present invention. The above noted prior art includes many problems or disadvantages. For instance, they are typically designed for use with standard rigid walkers and employ uncomfortable seat materials such as flat hard seat panels. In addition, with respect to the attachment devices, they are often flawed by lack of ease of attachment to structural members of the walker frame elements which limit their ease. Another common flaw is the lack of structural soundness and reliability to provide support for an extended period of time. Furthermore, the prior art foldable seats typically require specifically directed activity on the part of the user for moving the seat from an inoperative position to an operative position and insuring that the seat is in a secure condition. A further disadvantage of prior art folding seats is that they are not intended to be used for an extended period of time such as viewing television programs in a community area where seating is limited.

Accordingly, it is an object of the invention to provide for the rapid and easy movement of a collapsible seat into an operative position from a retracted inoperative position with a minimum of articulation of the user's hand. A critical feature accordingly must use one or both hands on the walker in addition to both feet for mobility. Accordingly, at such time as the user wishes to place the collapsible seat into an operative position, only one hand typically is available for use, the other being used to hold the walker for balance. Furthermore, users typically have impaired vision as well as reduced strength such that it is important that the folding seat have a handle for movement of the foldable seat into an operative position that is both easy to see and easy to operate in a "fail safe" mode.

Accordingly, it is desirable to provide for a new and improved folding seat apparatus for use with walkers which is lightweight, easy to operate and which is configured to fit different types of walkers (both folding and standard fixed) to a retrofit seat kit designed for different types of walkers and to a method of installing the kit which overcomes at least some of the disadvantages of prior art.

SUMMARY OF THE INVENTION

The present invention relates to a folding seat for use with different types of walkers, to a retrofit kit for retrofitting different types of walkers including folding and fixed walkers and to a method of installing the folding seat to a walker.

In particular the invention is directed to a lightweight folding seat attachment for a walker, particularly a folding walker having a lightweight frame having a front portion, a left frame portion and a right frame portion said left and right A-frames pivotally connected by at least two cross braces in a manner that enables the side A-frame portions to be moved between a closed folded position and an open seat position. The folding seat is divided into two seat panels supported on a lightweight folding frame wherein said folding frame is pivotally attached to the walker frame by back support connector devices supporting the two back corners of the bifold seat and having front support belts connected to the walker frame for supporting the front corners of the bifold seat. The bifold seat further includes a combination handle and center cross rod extending across the folding frame to permit the bifold seat to be moved from an in-use seat position to a raised folded position wherein it is stored against the front of said folding walker and does not interfere with the use of the walker.

As provided in the present invention, the bifold seat can be quickly and simply attached to many walkers and affords instant security and comfort when a user of the walker feels faint or fatigued. Said seat provides independence and self esteem for the user as the need for assistance is reduced. It is also of great benefit to a home, extended health care facility or hospital because it reduces the personnel needed to assist the person using the walker.

In the preferred embodiment, the invention is directed to a folding seat attachment for a folding walker, said walker having a lightweight tubular frame including a left side A-frame and a right side A-frame. Each side A-frame having a fixed vertically extending front leg, a folding vertically extending rear leg and a side brace connecting each front and rear legs consisting of at least one transverse strut. The frame includes a pair of cross braces at the front of the walker for pivotally connecting the left side A-frame to the right side A-frame pivotally connected at opposite ends of the cross brace to the left and right side A-frames in a manner that enables said side A-frames to be moved between folded stored position and an open seat position. The walker frame also includes corner braces for securely bracing the frame in an open position consisting of a first and a second corner brace connected respectively at the corner formed by the strut and the left and right side A-frames.

In this embodiment, the folding seat attachment is provided with a bifold seat member divided into two panels separated by a handle member, said seat being pivotally attached at the back of the seat to the walker frame. Said panels are mounted on a folding frame and are constructed of two panels of fabric material, typically Texalene®. The lightweight folding aluminum frame of the seat includes a pair of articulated arms; each arm having a central pivot point, each arm having a connected end and an opposite free end, and each arm pivotally mounted at the connected end to one of a pair of support connectors mounted on the front legs of the walker frame over the walker frame. The folding frame includes arched cross rods extending transversely between the pair of articulated arms for connecting the right articulated arm to the left articulated arm. Said cross rods are comprised of a front downwardly arched cross rod extending between the free ends of the articulated arms, a back arched cross rod extending between the connected ends of the articulated arm and a combination handle and center cross rod extending between a first central pivot point and a second central pivot point of the articulated arms to permit the seat to be moved from a horizontal in-use position to a raised folded position stored against the front of said folding walker.

In the present invention support for the folding seat is provided at the four corners of the bifold seat for enhanced safety and consists of a pair of back support connectors attached by clamping to the front legs of the walker frame and front support belts for supporting the front corners of the bifold seat consisting of a belt. Said belt includes a buckle for adjusting the length thereof and consists of nylon fabric arranged to extend over the upper side brace of a side A-frame, said buckle device being adjustable for adjusting the level of the seat when in the flat seated position for the appropriate knee height of a user. The front support belt device is configured to support the two front corners of the bifold seat and the back support connector supports the back two corners.

When in the open position, the combination of the two fabric panels and the downwardly arched connecting rods provide for a curved seat surface to provide comfort for the user over an extended period of time when used as a seat. Also the upper portion of the side A-frames normally used as hand grips also provide for arm rests and the cross braces provide for a back rest for the user.

The lightweight folding frame, typically constructed of aluminum, is preferably attached to the walker at a height appropriate for the individual user. It has been found that the preferred height is at knee height, approximately 21" from the floor, such that when arising, an individual does not have to lift his weight above his knees. When the bifold seat is folded in its upright position at the front of the walker, the user can use the walker without interference from the seat as the bifold seat folds together with the two panels in parallel relationship. When the need arises, the seat can be instantly lowered to the level sitting position with one hand, leaving the other free to grip the walker. The seat material is constructed of fabric, typically Texalene® material and is easily cleaned. When the seat is in the upright stored position, a foldable walker can be quickly folded for storing or transporting in the back seat of a truck or car.

An alternate support apparatus is provided for adapting the folding seat of the present invention to different walker configurations. In the alternate support apparatus, the back support bracket comprises a leg clamp consisting of a split cylinder for gripping the walker frame at a leg and having a pivot bracket. The alternate support apparatus also provides for a front support for those walkers having no side braces wherein the front support consists of a split sleeve and attached loop assembly which is adapted to attach to the top of the A-frame adjacent the handle of the walker just in front of the handle grip.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

BRIEF DETAILED DESCRIPTION OF DRAWINGS

DETAILED DESCRIPTION OF THE PREFERRED EMBODIMENT

Figure 1:
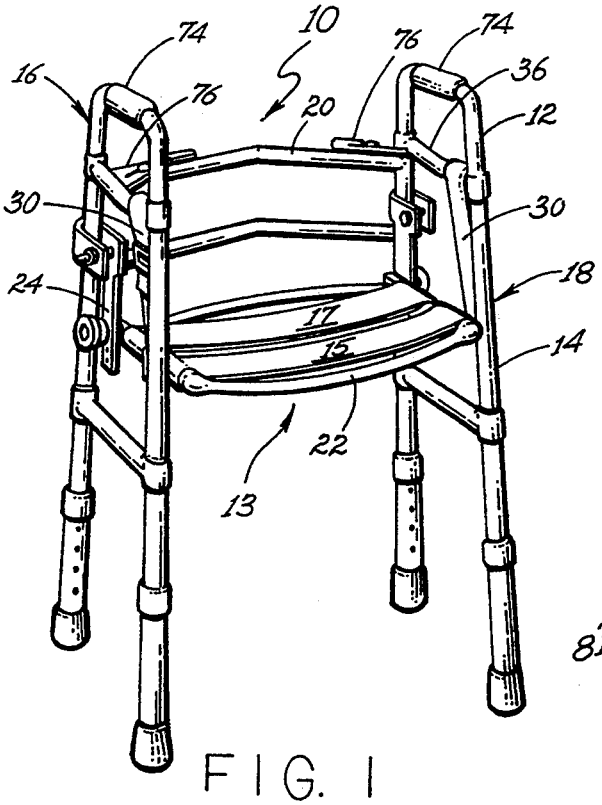
FIG. 1 is a prospective view from above showing a rear view of a folding walker with folding seat in an open deployed position.
Figure 2:
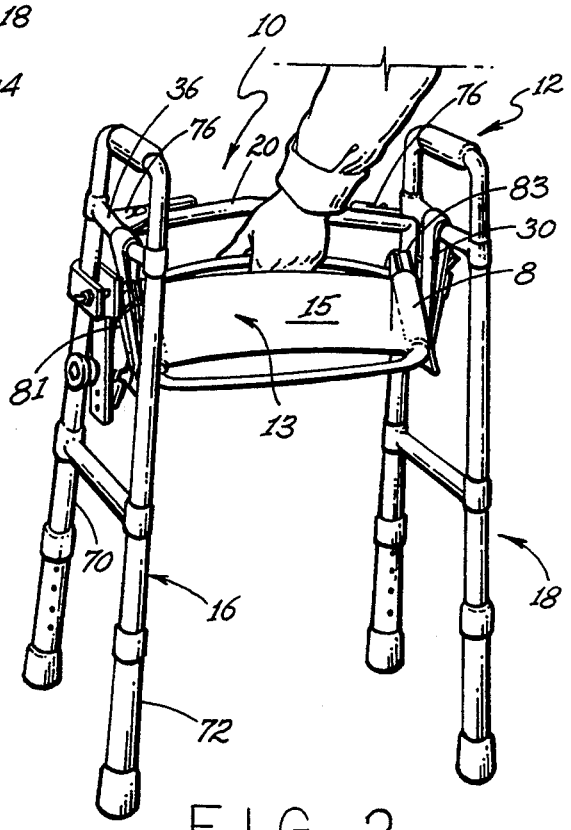
FIG. 2 is a prospective view of the invention of FIG. 1 showing the folding walker with the seat in the partially folded position.
Figure 3:
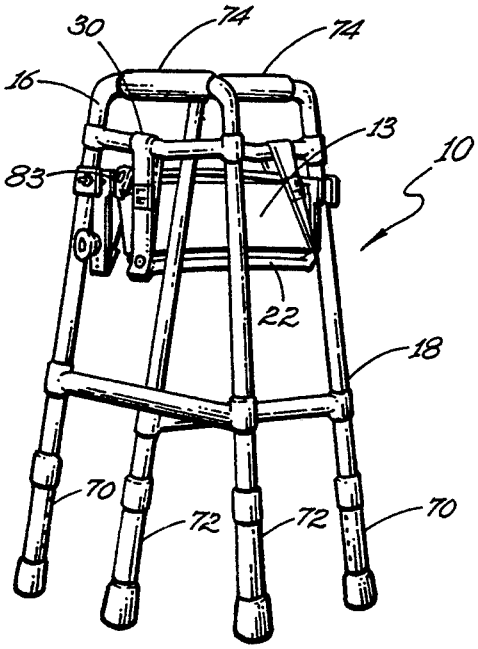
FIG. 3 is a side elevational view of the folding walker with seat of the invention of FIG. 1 showing the walker in an upwardly-folded stored position.
Figure 4:
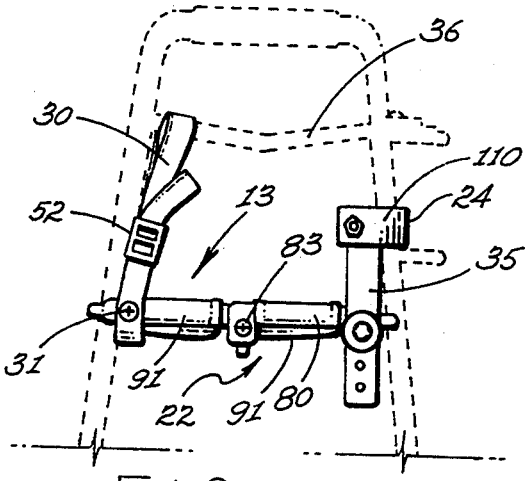
FIG. 4 is a side elevation view of the folding seat of the invention of FIG. 1 shown in a horizontal deployed position also showing a side view of the back support clamp and front support belt and buckle showing the deployed seat in a fully supported position.
Figure 5:
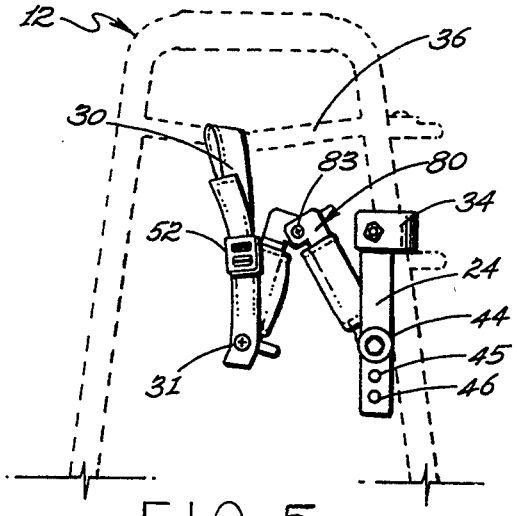
FIG. 5 shows the folding seat of the invention of FIG. 1 in an upwardly folded stored position.
Figure 6:
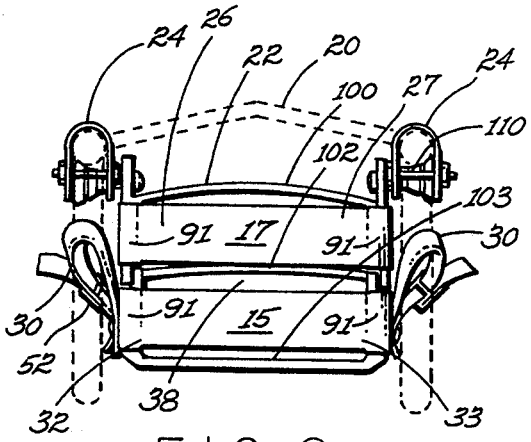
FIG. 6 shows a top view of the folding seat, with front and back port attachments relative to the folding walker frame of the invention of FIG. 1.

Referring to the drawings, as is shown in FIGS. 1–7, there is shown in combination a walker with folding seat 10 including a folding walker 12 having a bifold seat 13 mounted on a lightweight frame 14 with a left A-frame 16 and right A-frame 18. Said A-frames are pivotally connected by a cross brace 20 such that the folding walker 12 may be moved between a folded position and an open position. The bifold seat 13 includes two seat panels 15 & 17 mounted on a lightweight folding frame 22 pivotally attached to the walker frame 14 by a pair of back support clamp devices 24, as is shown in FIG. 2, supporting the back corners 26 & 27 of said bifold seat. As is shown in FIG. 4, a pair of front support belts 30 are securely fastened by fasteners 31 to the front corners 32 & 33 of the bifold seat 13 by being looped over side braces 36 of said A-frames. As is shown in FIG. 2, a combination handle and center cross rod 38 extends across the folding frame 22 to permit the folding seat 13 to be moved from a flat in use seat position as shown in FIGS. 1 & 4 to a raised folded position as shown in FIGS. 2, 5, & 8 wherein said folding seat is stored against the front of said folding walker and does not interfere with use of the walker.

Figure 7:
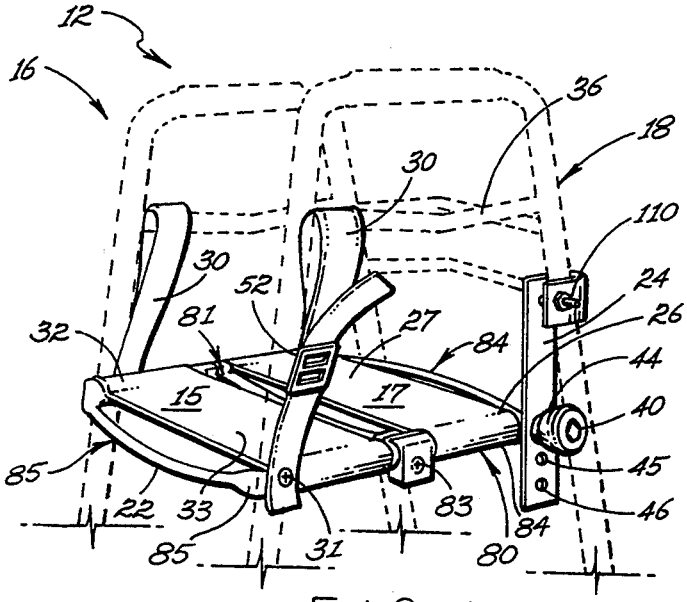
FIG. 7 shows a side prospective view of the folding seat shown in FIG. 4.
Figure 9:
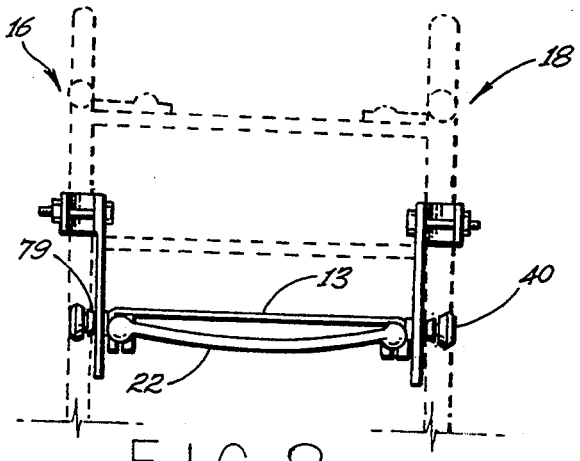
FIG. 9 is a front view of the folding seat attachment as shown in FIG. 4.
Figure 8:
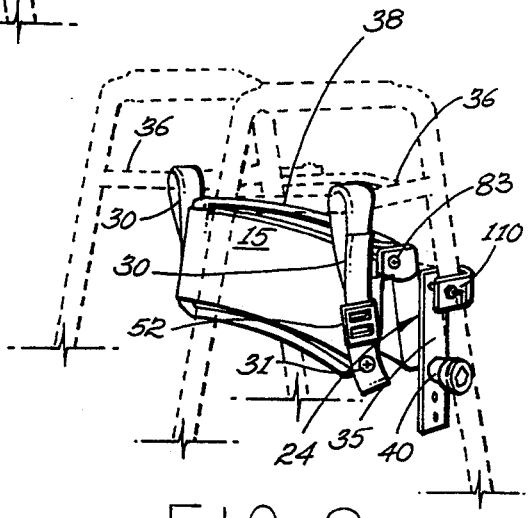
FIG. 8 is a side prospective view of the folding seat shown in the upward folded stored position of FIG. 5.
Figure 10:
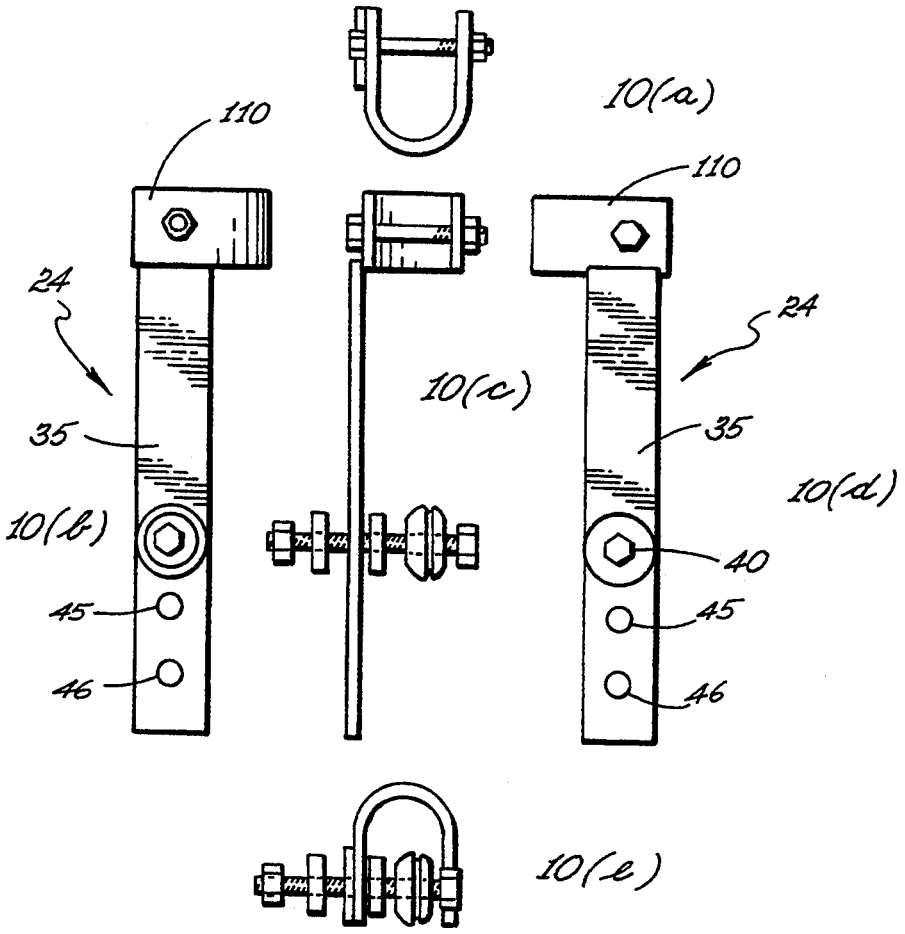
FIG. 10 is a detailed view of the clamp support device of the invention of FIG. 1 shown respectively as 10*a:* the end view, 10*b:* the right side view, 10*c:* the top view, 10*d:* the left hand side view, and 10*e:* the bottom view.

In the preferred embodiment, the pair of back support clamp devices 24, as is shown in FIGS. 4, 5, & 7, are fastened by bolts 40 to the folding frame 22. Said clamp devices 24 include a shaft 35 on which is mounted a perpendicularly oriented collar device 34 wherein said collar devices are clamped to an upper portion of the front legs 72 of said walker. The position of said brackets establishes the height of the seat relative to the height of the user and as positioned on said front legs. When clamped to the front legs 72, the shafts extend downwardly and include three holes 44, 45, & 46 at three elevations to allow users of varying heights to be comfortably seated by adjusting the height of the folded seat 13.

As is shown in the Figures, the nylon support straps 30 extend from each side of the folding frame adjacent to the front corners of the seat 32 & 33 to connect with side braces 36 of the walker frame 12. Said nylon straps are adjustable with strong buckles 52 to securely support the users weight.

In the preferred embodiment, the lightweight folding frame 22 is attached to the walker's frame 14 by mounting the back support clamp devices 24 at the appropriate position and selecting the appropriate hole 44, 45, or 46 at a height appropriate for the individual user.

In the preferred embodiment, the folding walker 12 includes a left side A-frame 16 and a right side A-frame 18 wherein each side A-frame includes a vertically extending front leg 70 and a vertically extending rear leg 72 and a side brace 36 connecting each said front and rear legs consisting of at least one transverse strut of conventional construction. The folding walker frame 12 includes a pair of cross braces 20 at the front of said walker pivotally connecting the left side A-frame 16 to the right side A-frame 18 and includes at least one transverse grip member 74 connected at opposite ends thereof to the left and right A-frames. Said walker frame also includes corner braces 76 positioned at the joining of the first and second corner brace with the left and right side A-frames 16 & 18. In the preferred embodiment, the bifold seat 13 is divided into two panels 15 & 17 separated by the handle member 38, said seat being pivotally attached to the walker frame 14 at pivots 79.

The lightweight folding aluminum frame 22 includes a pair of articulated arms 80 & 81. Each arm having a central pivot point 83 and each arm having a connected end 84 and an opposite free end 85. In the preferred embodiment, arched cross rods extend transversely between the articulated arm 80 & 81 for connecting a front downwardly arched cross rod, a back downwardly arched cross rod, and a combination handle and cross rod extending between the first central pivot point 83 to permit the bifold seat to be moved from a flat in use position into a raised folded position.

Figure 11:
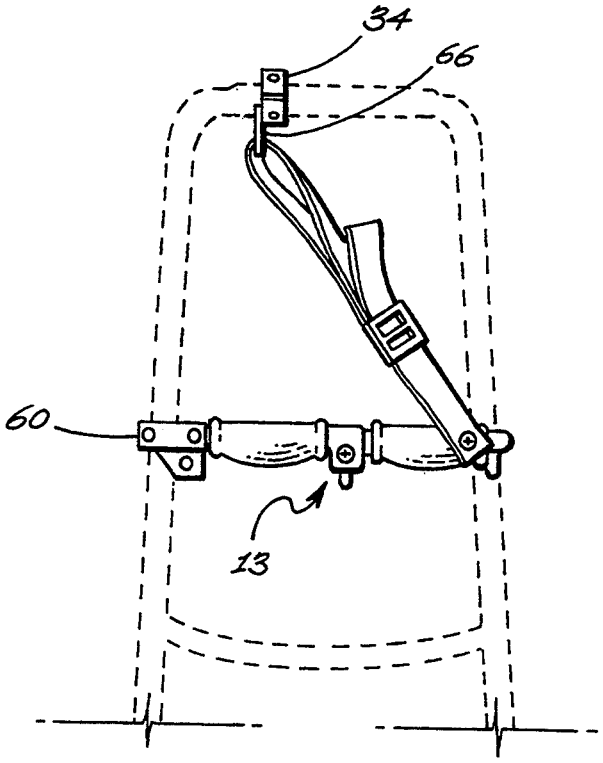
FIG. 11 is a side view of an alternate embodiment of the invention employing a leg clamp device and a the side clamp support device of an alternate support for the folding seat shown in FIG. 4.
Figure 12A:
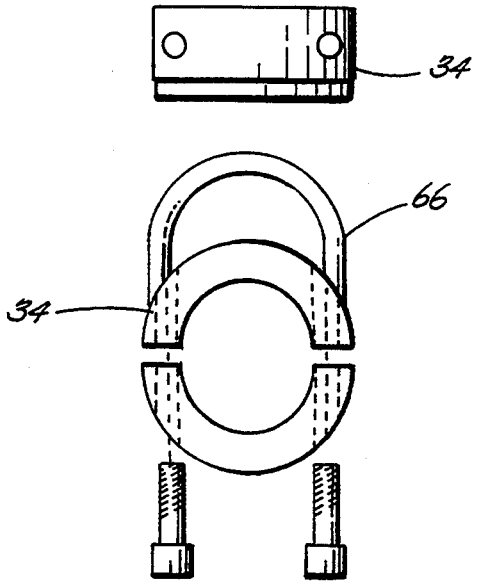
FIG. 12 is a detailed view of the collar device with loop shown as 12*a* of the alternate embodiment with rings of the folding seat of FIG. 11.
Figure 12B:
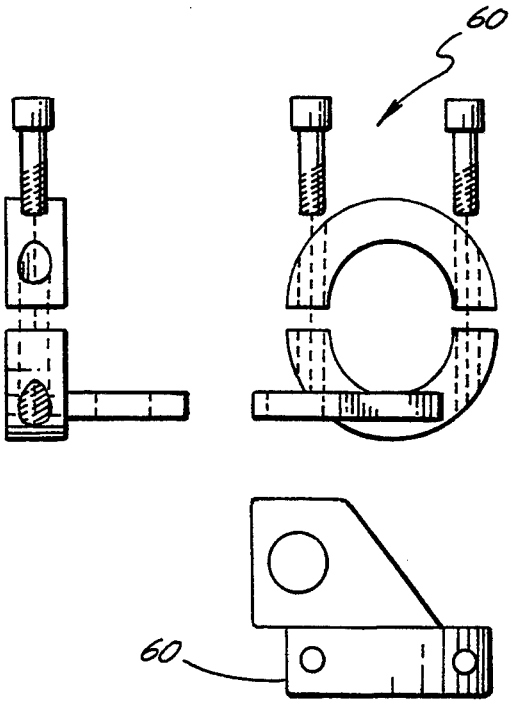
Figure 12C:
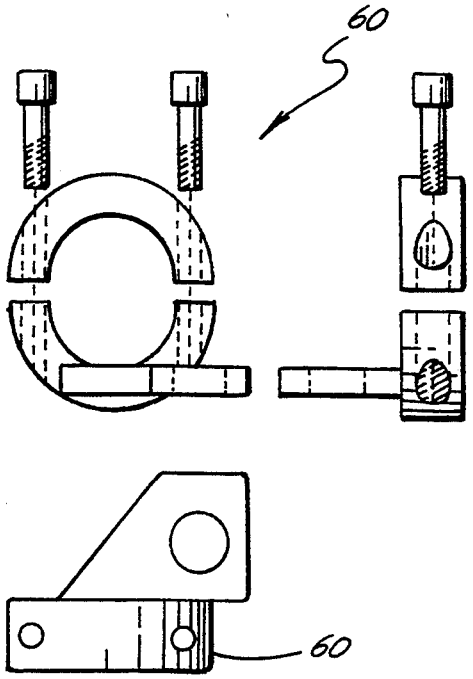

It is recognized that there are many different designs of walkers. Many of which include the side braces adapted for mounting the nylon support straps, which are adapted to accommodate the preferred embodiment. For such walkers which do not include the side brace, an alternate embodiment of support devices is provided herein after. As is shown in FIGS. 11 & 12 a front leg clamp assembly 60 is provided which can support the back of a bifold seat if the design of the walker does not accommodate the back bracket support of the preferred embodiment. The leg clamp assembly apparatus 60 can support the back of the bifold seat 13 as is shown in FIG. 11 which also discloses an alternate design showing a collar device 34 with rings 66 which is used when the frame does not include a side brace.

The folding seat is furnished in kit form and includes alternate attachments shown in FIGS. 4,7,10 & 12 with four cylindrical aluminum alloy side supports with joints as indicated. Three aluminum alloy cross rods 100, 102 & 103 are slightly arched and connect the side supports 91 at the front of the seat, the middle of the seat and the back of the seat. From the back support clamp 24 two side support extensions with ⅜ holes accommodate the bolts to connect with attachments for walker leg clamp assemblies 60 or said brackets. Two strips of Texalene® complete the comfortable seat and are fastened with screws beneath the aluminum side supports. FIG. 11 shows elevation views of walker front leg brackets for support of the back of the seat. In the preferred embodiment, semi-circular bracket tops 110 fit around front walker legs above cross bar, FIG. 10, between the front walker legs. Bolt assembly attaches support brackets to holes in seat side frame extensions at the back of the seat. Bolt assembly consists of ⅜" bolt, nut and spacers appropriately used for varying widths of different design walkers for alternate designs of walkers which do not accommodate the bracket bolt assembly. Simple walker leg clamps with ⅜" holes for bolt assemblies are shown in figure 12. Left front walker leg clamp, FIG. 11, and right front walker leg clamp are in two sections held together with fasteners, namely socket head cap screws which are adjusted with as Allen Wrench. FIG. 11 illustrates the way this clamp grasps the front walker leg and supports the back of the folding seat.

For another alternate design of walker, having no side brace between the front and back legs, a collar with rings 34, FIG. 11, is fastened in the front of the handle grip on each side of the walker. Each collar is fastened so that the ring is below the collar, FIG. 11, to suspend nylon strap connected to the side of the seat frame near the front of the seat.

The preferred embodiment also includes a method of attaching a folding seat simply and quickly to a plurality of walkers as is set for the hereinafter.

A. "Guardian Products" Foldable Walker

1. Unfold walker.
2. Hold seat inside walker at about knee height,
3. Attach seat-walker connector from right rear of seat to the left front walker leg-just above the front cross brace.
4. "U" shaped end of connector should hook around walker leg from front to rear.
5. 3/16" bolt is then inserted across the open ends of connector.
6. Same procedure is now used for left side of seat.
7. Nylon belt from right front of seat is passed over the upper side brace of walker and then buckled appropriately to make seat level.
8. Follow same procedure for belt on left side of seat.
9. Seat-walker connector has 3 bolt holes for different seat height options.

B. "Lumex" Foldable Walker and a Plurality of Foldable Walkers Without Upper Side Braces 1. Unfold walker.
2. Hold seat inside walker at about knee height.
3. Attach connector from right rear of seat to the left front walker leg just above the front cross brace of walker.
4. "U" shaped end of connector should hook around the walker leg from front to rear.
5. 3/16" bolt is then inserted across open ends of connector.
6. Same procedure is now used for left side of seat.
7. Attach one of the two-piece sleeves with attached loop to left handle of walker-just in front of hand grip.
8. Follow same procedure for right side.
9. Seat-walker connector has 3 bolt holes for different seat height options.

C. Folding Seat for Plurality of Standard Rigid Walkers

1. At about knee height, attach left leg clamp to left front leg of walker so that section with ⅜" diameter hole is above clamp and on the inside of walker leg. When clamped on walker leg, 45° angle of vertical section with hole should face forward.
2. Attach right leg clamp to right front walker leg—following the same procedure as above. This clamp should be attached at same height as the clamp on the left front walker leg.
3. Slide 5/16" bolt through the hole on left leg clamp and also through hole in frame at right rear of seat. Tighten nut on bolt.
4. Follow same procedure on right front walker leg.
5. Fasten one of the two-piece sleeves with attached loop to the left handle of walker—just in front of hand grip. Loop should be below handle of walker.
6. Follow same procedure on right side.
7. Pass the end of right nylon seat belt through sleeve loop and buckle appropriately to make seat level.
8. Follow same procedure on left side of seat.
9. Seat height can be raised or lowered by simply adjusting leg clamps and belt length.

What is claimed is:

1. A folding walker and folding seat in combination comprising:

a) a folding walker comprising:
   i) frame means comprising a left side A-frame and a right side A-frame with each side A-frame having a fixed vertically extending front leg, a folding vertically extending rear leg and a side brace connecting the front and rear legs;
   ii) cross brace means for pivotally connecting the left side A-frame to the right side A-frame comprising at least one transverse horizontally extending rib member pivotally connected at opposite ends thereof to the left and right side A-frames in a manner that enables said side A-frames to be moved between closed folded and open positions; and
   iii) corner brace means for bracing the frame means in the open position comprising a first and a second corner brace connected respectively between the cross brace means and the left and right side A-frames.

b) seat means comprising:
   i) a bifold seat divided in two seat panels mounted on a pair of articulated arms pivotally attached to the frame means, said panels comprising front and back seat panels each consisting of fabric material fastened to said arms;
   ii) the pair of articulated arms each having a central pivot point, a connected end and an opposite free end and each pivotally mounted at the connected end on a support means located on a front leg; and
   iii) cross rod means for connecting a right articulated arm to a left articulated arm comprising a front arched cross rod, a back arched cross rod and a combination handle and center cross rod extending transversely between said arms;

c) support means for supporting the seat means on the frame means comprising:
   i) back support means for pivotally supporting the back of the bifold seat comprising a pair of brackets, each bracket having a clamp fastened to the front leg of a side A-frame; and
   ii) front support means for supporting the front of the bifold seat comprising a belt connected to the walker frame having buckle means for adjusting the belt level, wherein the seat may be moved from a flat seat position to an raised folded position supported by the support means against the front of the walker permitting use as a walker.

2. The combination folding walker and folding seat attachment of claim 1 wherein the cross rod means comprises a front arched cross rod extending between a pair of free ends of the articulated arms, a back arched cross rod extending between the connected ends of the articulated arm and a combination handle and center cross rod extending between a first central pivot point and second a central pivot point to permit the seat to be moved from a flat in-use position to a raised folded position stored against the front of said folding walker.

3. The combination folding walker and folding seat attachment of claim 1 wherein the brackets of the back support means has 3 bolt holes for different seat height options.

4. A multifunctional folding seat adjustable for use with multiple configurations of walkers comprising:

a) a folding seat means comprising:
   i) bifold seat panel for pivotal attachment to the frame means having a front and back comprising two seat panels pivotally connected, including at least two panels of fabric material;
   ii) a pair of articulated arms each having a central pivot point a connected end and an opposite free end and each end is pivotally mounted at the connected end on the bracket located on a front leg; and
   iii) cross rod means for connecting a right articulated arm to a left articulated arm comprising a front arched cross rod extending between the free ends of the articulated arms, a back arched cross rod extending between the connected ends of the articulated arm and a combination handle and center cross rod extending between a first central pivot point and a second central pivot point to permit the seat to be moved from a flat in-use position to a raised folded position stored against the front of said folding walker;

b) support means for supporting the seat means on the frame means comprising:
   i) back support means for pivotally supporting the back of the bifold seat panel comprising a pair of brackets, each bracket having a clamp configured to be fastened to one of the front legs of a the walker frame; and ii) front support means for supporting the front of the bifold seat panel comprising an adjustable belt connected to the frame of the walker and having buckle means for adjusting the height of the bifold seat and for supporting said seat at the front corners comprising a fabric belt, wherein the seat may be moved from a flat seat position to an raised folded position.

5. The multifunctional folding seat of claim 4 wherein the back of the seat is pivotally connected to a pair of leg clamps, each leg clamp consisting of a split ring device with threaded allen head fasteners clamped to a front leg.

6. The multifunctional folding seat of claim 4 wherein the front support means comprises a pair of split collars associated with an adjustable belt with each of said collars having a ring to suspend the belt from the top of a side A-frame adjacent a hand grip of the walker.

7. The multifunctional folding seat of claim 4 wherein the two seat panels comprise two strips of Texalene® attached by screws to the bottom of the articulated arms for providing a curved comfortable seating surface.

8. A kit for retrofitting a walker with a foldable seat, having component parts capable of being attached to the walker, the kit comprising the combination of:

a) a seat for supporting a person, said seat configured for pivotal attachment to a walker frame having:

i) bifold seat divided into two panels constructed of fabric;

ii) back support means for pivotally supporting the back of the bifold seat panel comprising a pair of brackets, each bracket having a clamp for attachment to the front leg of a side A-frame;

iii) front support means for supporting the front of the bifold seat panel comprising a belt for connection with a side A-frame and having buckle means for adjusting the belt to the height of the user and making the two seat panels level;

iv) a pair of articulated arms each having a central pivot point, a connected end and an opposite free end, and each having a journals at the connected end for pivotal connection with the bracket connectors; and v) cross rod means for connecting a right articulated arm to a left articulated arm comprising a front arched cross rod extending between the free ends of the articulated arms, a back arched cross rod extending between the connected ends of the articulated arm and a combination handle and center cross rod extending between a first central pivot point and a second central pivot point to permit the seat to be moved from a flat in-use position to a raised folded position stored against the front of said folding walker.

* * * * *